US006354561B1

(12) United States Patent
Fahrion

(10) Patent No.: US 6,354,561 B1
(45) Date of Patent: Mar. 12, 2002

(54) ADJUSTABLE CASTING MOULD, AND DEVICE FOR ADJUSTING THE MOULD SURFACE THEREOF

(76) Inventor: Otmar Fahrion, Dürerstrasse 9, D-70806 Kornwestheim (DE)

( * ) Notice: Subject to any disclaimer, the term of this patent is extended or adjusted under 35 U.S.C. 154(b) by 0 days.

(21) Appl. No.: 09/214,642

(22) PCT Filed: Jul. 3, 1997

(86) PCT No.: PCT/EP97/03504

§ 371 Date: Jun. 1, 1999

§ 102(e) Date: Jun. 1, 1999

(87) PCT Pub. No.: WO98/02262

PCT Pub. Date: Jan. 22, 1998

(30) Foreign Application Priority Data

Jul. 11, 1996 (DE) ..... 196 37 930

(51) Int. Cl.[7] ..... B28B 7/02; B41B 11/68

(52) U.S. Cl. ..... 249/155; 249/158; 425/150; 425/195

(58) Field of Search ..... 425/150, 195, 425/2; 249/155, 158

(56) References Cited

U.S. PATENT DOCUMENTS 2,410,888 A * 11/1946 Lucy ..... 264/219
3,630,480 A * 12/1971 Inouye ..... 249/106
4,070,428 A * 1/1978 Krall et al. ..... 264/89
4,200,272 A * 4/1980 Godding ..... 269/29
4,826,639 A * 5/1989 Vidal et al. ..... 264/32
4,934,918 A * 6/1990 Outland ..... 425/144
5,281,117 A * 1/1994 Hong ..... 425/2
5,513,972 A * 5/1996 Schroeder et al. ..... 425/175
5,523,040 A * 6/1996 Krouskop ..... 264/163
5,546,313 A * 8/1996 Masters ..... 364/468.03
5,846,464 A * 12/1998 Hoffman ..... 264/219
5,851,563 A * 12/1998 Hoffman ..... 425/175

FOREIGN PATENT DOCUMENTS

WO WO8602877 * 5/1986 ..... 425/195

* cited by examiner

*Primary Examiner*—Nam Nguyen
*Assistant Examiner*—Emmanuel S. Luk

(57) ABSTRACT

The invention relates to an adjustable casting mold with a plurality of axially displaceable molding pins. Each molding pin has a self-locking threaded mechanism by way of which the molding pin is supported on a carrier plate. The carrier plates on which in each case a plurality of adjustable molding pins are mounted are, in turn, connected to a molding-box housing member to be adjustable in a different manner perpendicular to the mold parting surface.

22 Claims, 9 Drawing Sheets

ADJUSTABLE CASTING MOULD, AND DEVICE FOR ADJUSTING THE MOULD SURFACE THEREOF

The invention relates to an adjustable casting mould and a device for adjusting the mould surface thereof.

BACKGROUND OF THE INVENTION

Known casting moulds include on the one hand those in which a sand moulding box is prepared each time a workpiece is cast. These sand moulding boxes are well suited for the small-batch manufacture of products. However they have drawbacks concerning the disposal of the used moulding sand. For example, the process of casting four propeller blades for a marine propeller entails 80 $m^3$ of moulding sand which is to be disposed of. These problems can only be partly solved by reprocessing used moulding sand. Reprocessing is also expensive. The preparation of the sand moulding boxes is labour-intensive and time-consuming.

In addition, moulds which can be used many times are known for the large-batch manufacture of castings which are not overlarge. However these casting moulds are very expensive to produce, which means that it is out of the question to use them for small-batch production.

In order to produce a casting mould with an adjustable mould surface, DE 41 12 736 C2 has already proposed rod-shaped moulding pins which can be moved axially relative to one another so as to be clamped together in a frame, with the end faces of the variably adjusted moulding rods predetermining a staircase curve mould surface of adjustable geometry.

One disadvantage of an adjustable casting mould of this kind lies in the fact that the various moulding pins cannot be firmly fixed in position until they have all been brought into the desired axial position. The moulding pins may move under disturbing influences until they are thus fixed. Moreover, the process of fixing the positions of the moulding pins by clamping the entire pack of moulding pins together, in which case they are just fixed through pure frictional engagement, is not without problems: Firstly, the clamping forces under casting conditions may differ considerably from those under adjustment conditions on account of differing thermal expansion of the moulding pins and clamping frame. Secondly, the clamping forces must be cleanly transmitted from one moulding pin to the adjacent moulding pin in the moulding pin pack. This means that the side faces of the moulding pins must lie exactly flat against one another. The moulding pins must therefore be very accurately machined and, if re-used, adequately cleaned. However it is impossible to produce adjustable casting moulds for very large workpieces even if appropriate precautionary measures are observed, as the moulding pins—which are only held by frictional engagement—cannot take relatively high loads in the axial direction and may move in uncontrolled fashion under the effect of the weight of relatively large quantities of molten metal.

SUMMARY OF THE INVENTION

The object of the invention is therefore to develop an adjustable casting mould according to the preamble of claim 1 such that the position of the individual moulding pins is more securely fixed, even if the mould has large dimensions.

This object is achieved according to the invention by an adjustable casting mould.

The individual moulding pins of this mould are each supported by an associated stanchion which is adjustable in length. As each moulding pin has its own support, which is independent of the support of adjacent moulding pins, the concept according to the invention enables casting moulds of any desired size to be produced without any problems.

The concept according to the invention also enables groups of moulding pins to be assembled into sub-units which can be handled and transported without any risk of the adjusted mould parting plane changing, while still ensuring that the mould surface is substantially continuous, so as to be free from joints, after the various moulding pin groups have been positioned side by side.

Advantageous developments of the invention are presented in subclaims.

The use of a screw drive to support the moulding pins is of advantage with regard to a simple, precise adjustment of the end faces of the moulding pins. This adjustment may also be performed in a particularly simple manner by using a robot. A stanchion of this kind, adjustable in length, is also particularly insensitive to high temperatures.

The development of the invention is of advantage with regard to a good, reliable alignment of the moulding pins irrespective of their axial position.

The development of the invention ensures that the screw drive which is used to adjust a moulding pin is protected against high temperatures under casting conditions.

If the threaded hole or spindle nut of the screw drive is provided on the guide section, the screw drive can be adjusted particularly easily to the head, which always occupies the same axial position, of the adjusting bolt.

The development of the invention has the advantage of the position of the mould surface not changing significantly if the temperature prevailing during the casting operation differs from the temperature which was taken as a basis when predetermining the desired positions for the various moulding pins.

The development of the invention enables the initially stepped mould surface to be converted into a smooth mould surface through mechanical reworking.

The development of the invention enables the material of which the volume of the moulding pins consists to be selected so as to be particularly favourable with regard to its thermal properties or machinability, while still guaranteeing that the moulding pins are mechanically held together as desired. If the sheath is thin, it does not represent a high resistance for the machining tool should any reworking of a stepped mould surface by machining be carried out.

If groups of moulding pins are provided on carrier plates, these groups of moulding pins can be adjusted on easily surveyed, small devices, particularly using automatic machines. The use of groups of carrier plates bearing moulding pins is also of advantage with regard to easily fastening the moulding pins in the moulding box and with regard to providing moulding boxes of different sizes using uniform basic components. Because the carrier plates are in turn mounted on the frame of the moulding box so as to be adjustable in the axial direction of the moulding pins, it is also unnecessary to provide an excessively long axial displacement path for the individual moulding pins, although it is still possible to produce large castings having different dimensions parallel to the longitudinal axis of the moulding pins.

The development of the invention is of advantage with regard to easily mounting the carrier plates on the moulding box frame such that they can bear loads.

A casting mould enables the individual carrier plates and the moulding pin groups borne by them to be very easily connected to the moulding box frame, in which case the positioning of the moulding pin groups flush side by side automatically takes place in two directions perpendicular to one another (in the first instance through abutment, secondly through the spacing of the rails).

The development of the invention enables sub-regions of the mould surface, in which different demands are made on the variability of the mould surface, to be formed economically. Thus edge regions of the moulding box parting plane, which only serve to close the mould cavity, can in the extreme case simply be closed by carrier plates bearing just one cuboid moulding pin. These moulding pins then only need to be adjusted to the mould parting plane, this being the only adjustment operation required. Carrier plates which are provided with sprue channels and vent channels may then also be mounted in such edge regions of the moulding box.

The development of the invention is also of advantage with regard to easily introducing the moulding pins into the moulding box and easily removing them from the latter again.

The development of the invention enables the temperature at the moulding box frame and therefore at the mechanism for suspending and bearing the moulding pins to be maintained at a low level.

A casting mould has a substantially smooth mould surface. Where large casting moulds are concerned, the end faces of the moulding pins are preferably machined after the axial position of the moulding pins of a carrier plate has been adjusted in each case separately for such a moulding pin group. CNC machines with long traversing paths are therefore unnecessary. However, where such machines are available, it is also possible to rework the stepped surfaces formed by the moulding pin end faces to form a mould surface which is smooth throughout at the actual casting mould.

An uninterrupted mould surface can also be achieved by smearing the stepped surface formed by the moulding pin end faces with a heat-resistant mouldable material, whereby a substantially continuous mould surface is likewise obtained. If a casting mould thus smeared is re-adjusted, the moulding material applied to the end faces of the moulding pins will generally separate automatically if the moulding pins are displaced unequally. This may be further assisted by spraying the moulding pin end faces with a parting compound before the mouldable material is applied.

The development of the invention is of advantage with regard to minimising the weight of the moulding pins and/or their displacement mechanism, which facilitates handling of the moulding pins and entire moulding pin groups. If an end section of the moulding pins remains solid in this case, it is also possible to machine the end faces of such moulding pins to produce a continuous mould surface.

The development of the invention enables the end faces of the individual moulding pins to be automatically adjusted to the desired mould surface. This is of advantage in particular where very large moulds are concerned and for the frequently varying manufacture of different products.

BRIEF DESCRIPTION OF THE DRAWINGS

The invention is illustrated in detail in the following on the basis of embodiments and with reference to the drawings, in which.

DETAILED DESCRIPTION OF THE INVENTION

Figure 1:
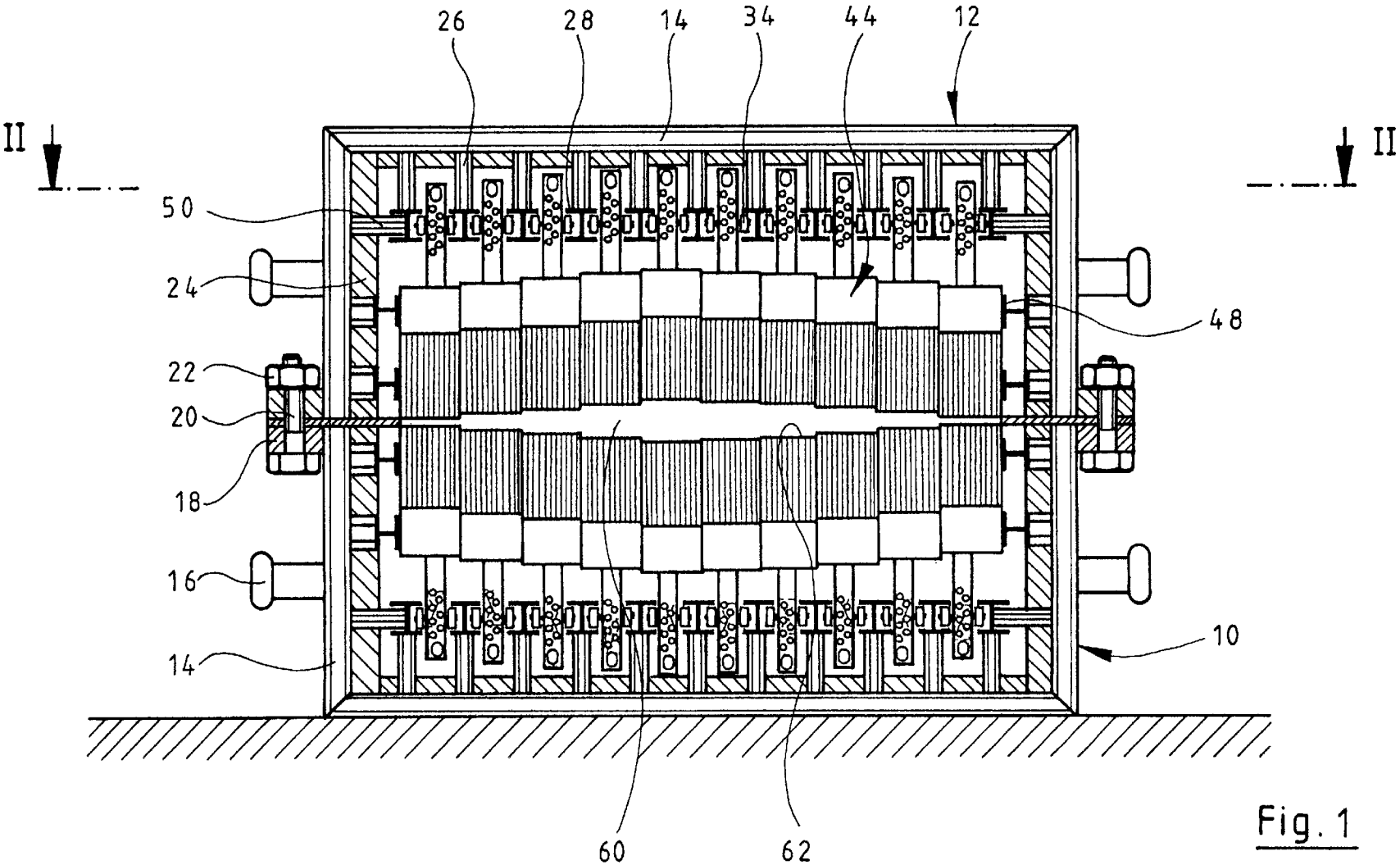
FIG. 1 is a vertical section through a casting mould for a propeller blade.

FIG. 1 reproduces a casting mould for a propeller blade of a marine propeller which consists of a lower moulding box designated as a whole by 10 and an upper moulding box designated as a whole by 12.

The two moulding boxes 10, 12 are basically of the same structure, so that it is sufficient to describe one of the moulding boxes in detail. In order to present a clearer picture, reference numbers for components of the two moulding boxes 10, 12 have only been entered once for one of the moulding boxes.

The moulding boxes each have a bearing box part 14, the outside of which is fitted with bearing bolts 16, from which cable straps can be suspended. The box parts 14 also have straps 18 adjacent to the mould parting plane, at which straps the two moulding boxes 10, 12 can be joined together by means of bolts 20 and nuts 22 in a separable manner.

Figure 3:
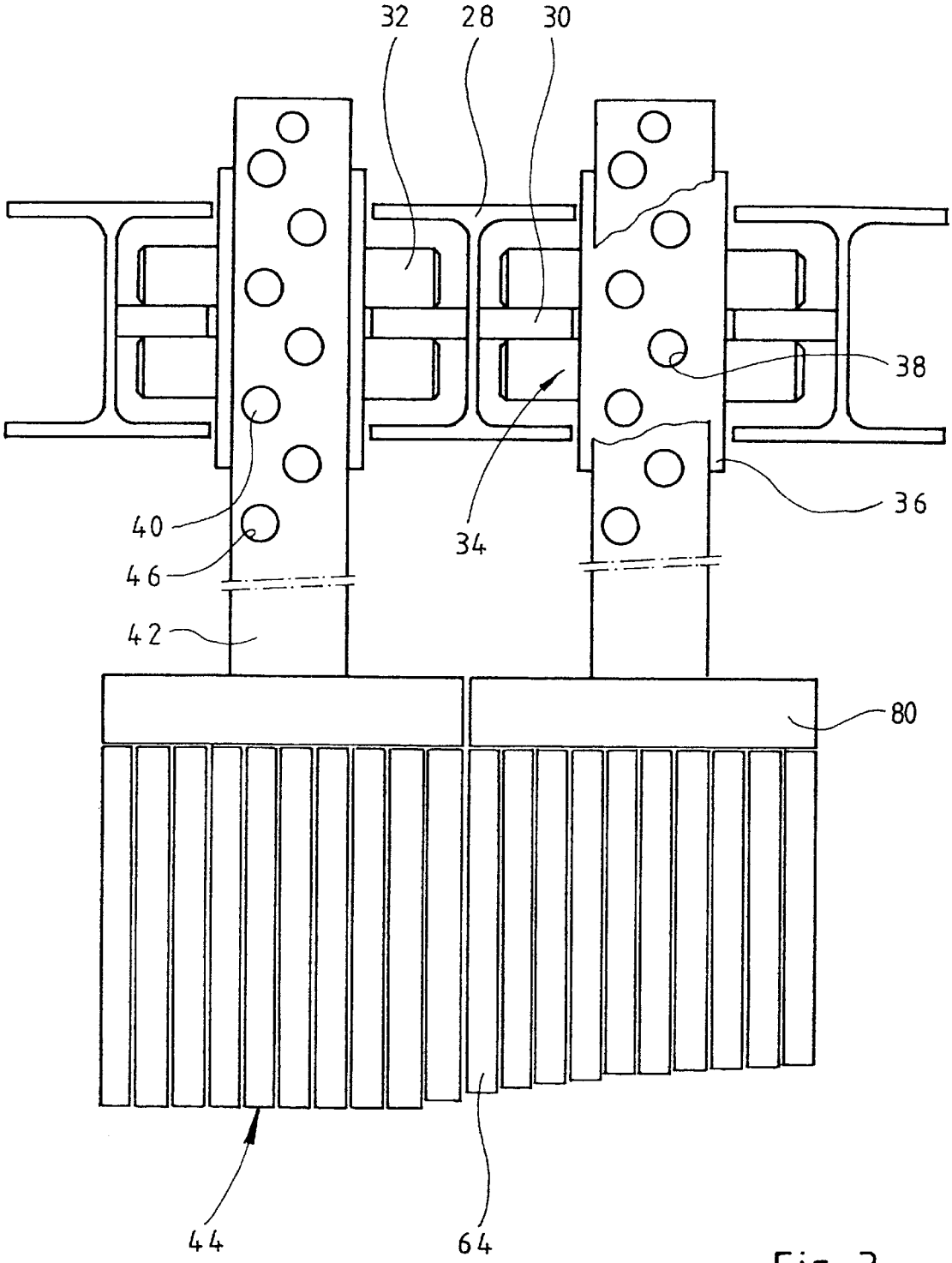
FIG. 3 is a front view of two adjacent moulding pin units of the casting mould shown in FIGS. 1 and 2.

The inner surfaces of the box parts 14 are covered by heat-insulating linings 24. Vertical supports 26 extend through the latter, which supports are fastened to the bottom or covering wall of the moulding box part, are arranged in regularly spaced rows and each of which bears rails 28. The cross-sectional shape of the rails is similar to that of an I-beam. As can be seen from FIG. 3, running walls 30 are welded onto the vertical webs of the rails 28. These walls co-operate by way of their top side and underside with vertically spaced running pins 32 (or wheels), which are part of a running head designated as a whole by 34. The latter also includes a fastening plate 36, which is provided with locating openings 38.

Mounting sections 42 of moulding pin units, which are designated as a whole by 44, can be fastened to the latter by means of locating pins 40, for which purpose the mounting sections 42 are provided with a set of locating openings 46, various of which can selectively be moved into a position of alignment with the locating openings 38. The moulding pin units 44 can thus be connected to the running heads 34 in different vertical positions and suspended via these from the rails 28.

Figure 2:
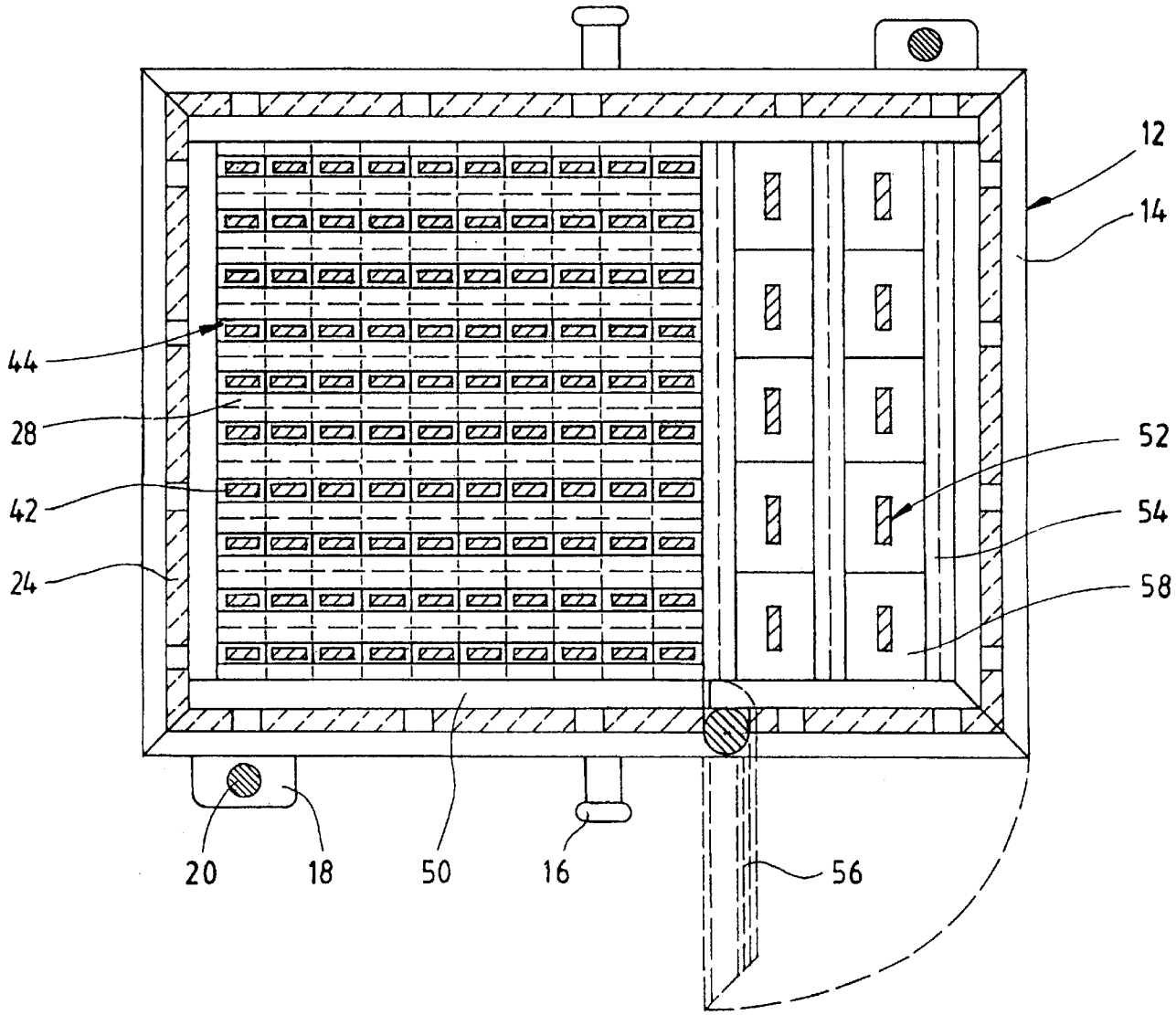
FIG. 2 is a horizontal section through the casting mould shown in FIG. 1 along the intersection line II—II in the latter.

As shown in FIGS. 1 and 2, the spacing of the rails 28 is exactly equal to the transverse dimension of a moulding pin unit 44. If moulding pin units 44 are inserted in succession perpendicularly to the plane of the drawing in the rails 28, lying side by side and extending perpendicularly to the plane of the drawing in FIG. 3, a mould surface curved in stepped fashion in two directions can be produced according to the different vertical positions of the moulding pin units. The lower end faces at the back of the moulding pin units lying in the plane of the drawing have been omitted from FIG. 1 to provide a clearer view. Of course these end faces advance towards the edge of the moulding boxes and in the same way towards the mould parting plane perpendicularly to the plane of the drawing, as represented for the lateral direction in FIG. 1.

In order that the rails and running heads 34, which position the moulding pin units, do not need to absorb large tilting moments under casting conditions (in this case the clearance between the running pin 32 and the running wall 30 would have to be very small, which would have a detrimental effect on the displaceability of the running heads 34), the circumferential walls of the box parts 14 also bear lateral support rails 48, which act in a region of the edge moulding pin units 44 which is adjacent to the fastening plate 36 or a region which is adjacent to the end faces of these moulding pin units. These support rails may be preloaded by springs or capable of being advanced towards the interior of the box by tension screws which are not shown in detail in the drawings.

Further lateral support rails 50 engage in the outside of the edge rails 28. They are in turn borne by the box part 14.

The interior of the casting mould is divided into two sections in the embodiment considered here: One section, which is located on the left in FIG. 2, contains the actual moulding space, which has a finely stepped mould surface complying with the product surface and is formed by a plurality of moulding units 44 having small dimensions, as described above. A mould section located on the right in FIG. 2 contains those parts of the mould cavity relating to the sprue. This section of the casting mould does not require a precisely predetermined mould surface, so that moulding pin units 52 whose edge dimensions are in each case twice the edge dimensions of the moulding pin units 44 are used here. In the embodiment under consideration here rails 54, on which the moulding pin units 52 are mounted in a manner similar to that described in detail above for the moulding pin units 44 in connection with the rails 28, are mounted in a direction perpendicular to the direction in which the rails 28 extend. The moulding pin units 52 can be fitted and removed through a pivotable door provided in a side wall of the box part.

The moulding pin units 52 have predominantly one-piece, cuboid moulding pins 58, which contact one another with their end faces at the mould parting plane. Only the three central moulding pins of the row of moulding pin units 52 located on the left in FIG. 2 are formed with sprue channels and distribution channels, which are not shown, for molten metal, these leading into the moulding space 60 defined by the moulding pin units 44 (cf. FIG. 1).

The result of mounting the moulding pin units 44 on the rails 28 with their locating openings 46 aligned with the locating openings 38 in differing positions is a relatively roughly graduated stepped mould surface 62, as shown in FIG. 1. In order to enable the mould surface 62 to be more precisely adjusted to a desired workpiece surface, the moulding pin units 44 each comprise a plurality of individual moulding pins 64 which are arranged in the form of a matrix and can be displaced independently of one another in the axial direction, as described in greater detail in the following. The step between adjacent moulding pins 44, which is large in the figure, can thus be broken down into a plurality of smaller steps between adjacent moulding pins 64. This results in a precise approximation of the mould surface 64 to the workpiece contour, as indicated in the right-hand part of FIG. 3.

Figure 4:
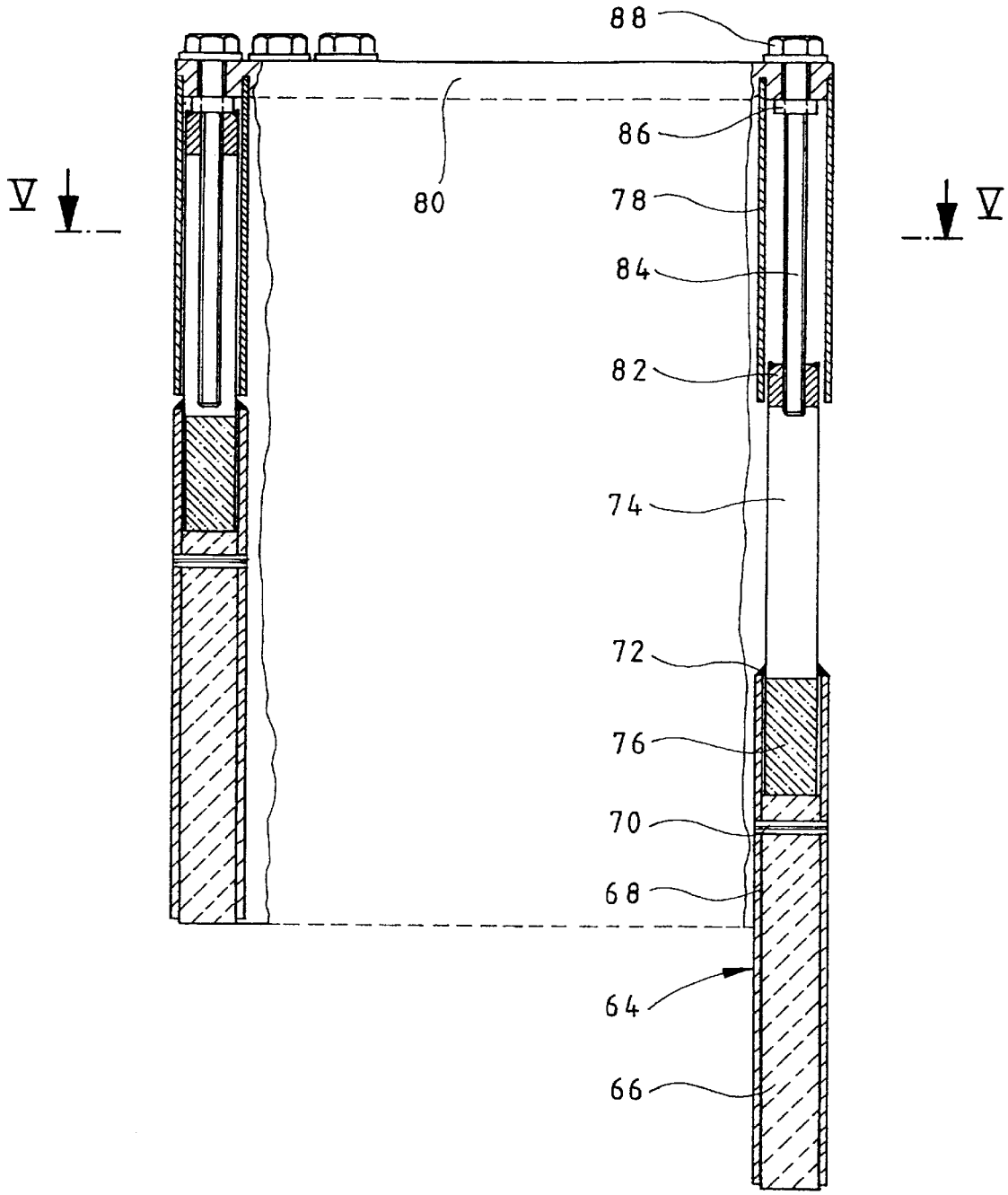
FIG. 4 is an enlarged side view of a moulding pin unit in which two moulding pins are reproduced in a completely inserted position and one of maximum extension, respectively.
Figure 5:
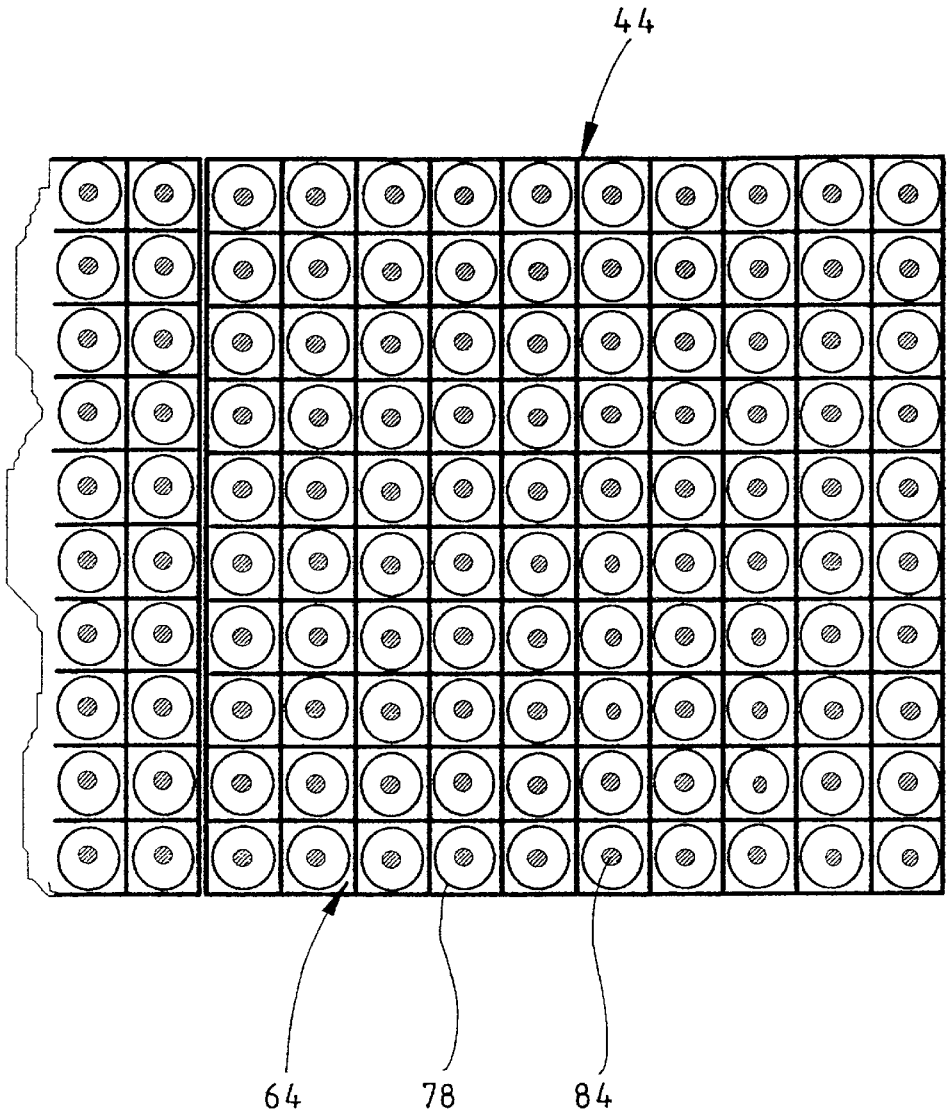
FIG. 5 is a section through the moulding pin unit shown in FIG. 4 and a part of an adjacent moulding pin unit along the intersection line V—V of FIG. 4.
Figure 6:
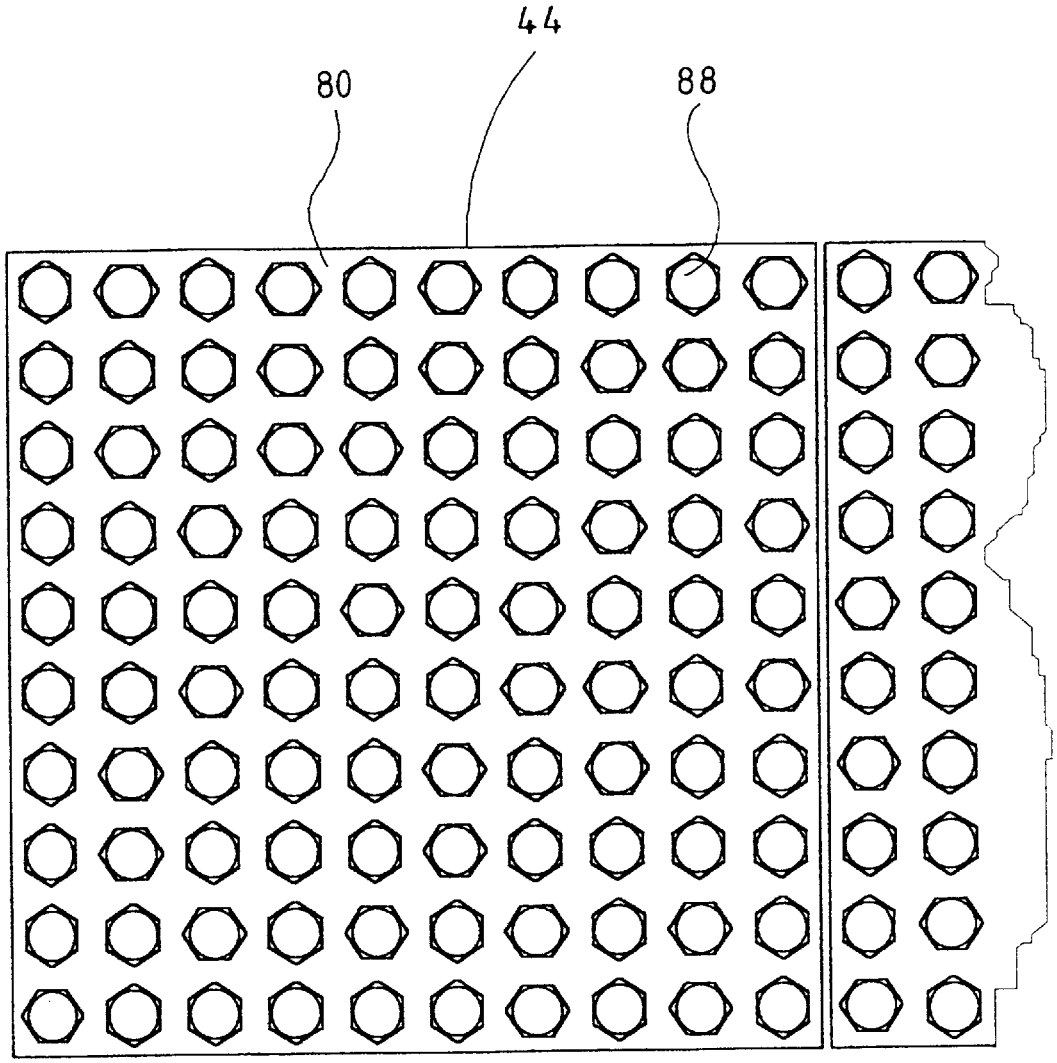
FIG. 6 is a plan view onto the top side of the moulding pin unit shown in FIG. 4.

The moulding pins 64 have (cf. FIG. 4) a core 66 which has a square cross section and is surrounded by a sheath 68 of just a slight wall thickness (its wall thickness is exaggerated in FIG. 4 just for illustration purposes). The core 66 consists of a material which only has a low coefficient of thermal expansion, at least in the temperature range occurring at the moulding pins under casting conditions, and preferably only a low coefficient of thermal expansion in the entire temperature range between ambient temperature and casting temperature. Graphite, for example, as used to produce electrodes, is a material of this kind. Another material which is suitable as regards thermal and mechanical properties is wood. However graphite is preferred, as this can easily be moulded industrially into rods of the desired geometry using the technology developed for graphite electrodes.

The graphite cores 66 are joined to the sheath 68 via transverse pins 70 such that they can be separated. The sheath 68 is joined to an inner telescopic part 74 via a weld 72, and an insulating piece 76 is arranged in the last facing end section of the sheath 68 in order to thermally isolate the telescopic part 74 and the graphite core 66.

The inner telescopic part 74 cooperates with an outer telescopic part 78, which is likewise cylindrical and the upper end of which is welded to a carrier plate 80. The inner telescopic part 74 and the outer telescopic part 78 together form a telescopic guide. A spindle nut 82 is welded into the upper end of the inner telescopic part 74. This co-operates with an adjusting bolt 84, the upper end of which bears a bearing disc 86 co-operating with the underside of the carrier plate 80. Together with a head 88 of the adjusting bolt 84, the bearing disc forms a radial/axial bearing. By turning the adjusting bolt 84 of a moulding pin 64, the end face of the latter can therefore be easily and precisely displaced in the axial direction between a completely inserted (left-hand half of FIG. 4) and a completely extended (right-hand half of FIG. 4) position.

The pitch, the profile and the fit of the thread of the adjusting bolt 84 and the spindle nut 82, as well as the material of the latter two parts, are selected such that the screw drive formed by them is self-locking under all casting conditions under which the casting mould is to be used, in the load-free state and under the shocks to which the casting mould is exposed.

As is obvious from the drawings, the moulding pins 64 each have a square cross section in the embodiment under consideration here, and each moulding pin unit 44 comprises a grid arrangement of 10×10 moulding pins and is therefore in turn likewise square.

Precise adjustment of the contour of a mould surface 62 can thus be carried out by displacing the various moulding pins 64 and rough adjustment of the contour of a mould surface 62 by locating the individual moulding pin units 44 at the associated running heads 34. It is thus also possible to produce workpieces whose surfaces vary considerably in the vertical direction with this limited displacement path of the individual moulding pins 64.

Figure 7:
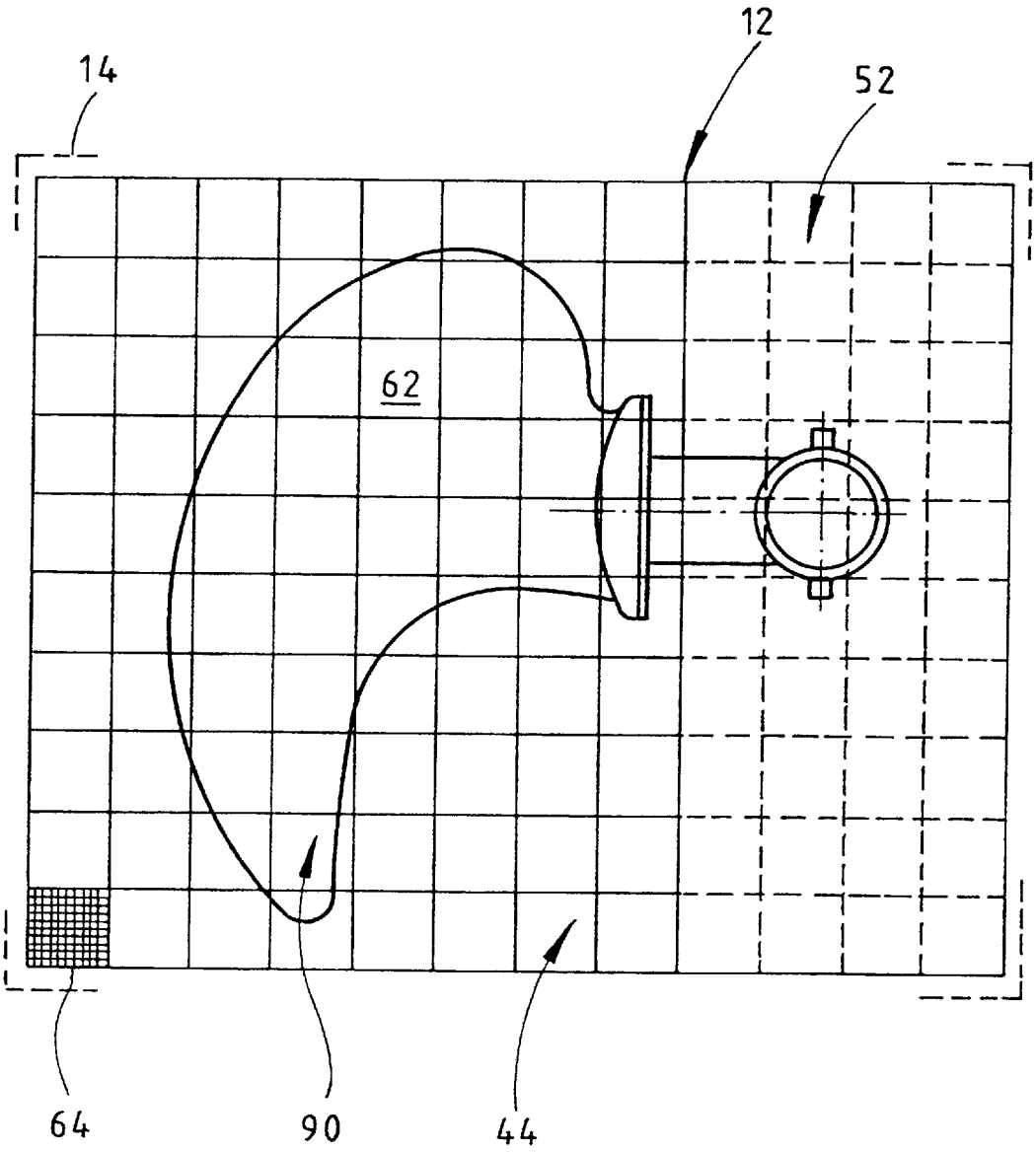
FIG. 7 is a diagrammatic plan view onto a moulding box of the casting mould shown in FIG. 1 and the mould surface predetermined by this.

FIG. 7 is a diagrammatic view of the profile of a propeller vane 90 for a marine propeller. The moulding pins 64 of all moulding pin units lying outside of the vane contour are fully advanced to produce this vane. The moulding pin units used here may alternatively also be simplified moulding pin units which simply comprise a single graphite block which is dimensioned such that the end face of the block lies in the mould parting plane when the moulding pin unit is appropriately located. As regards the moulding pin units 44 which are intersected by the peripheral contour of the propeller vane 90 or lie within this, the individual moulding pin units 44 are located and the moulding pin end faces axially adjusted so as to obtain a finely stepped mould surface which lies on the outside of the desired workpiece surface along its entire extent. The moulding pin units indicated by broken lines in FIG. 7 may again be formed by single-block moulding pin units, in the case of which the end faces of the blocks lie in the mould parting plane. Some of these last-mentioned moulding pin units are machined so as to produce a sprue channel.

The moulding boxes adjusted as described above are assembled to cast a workpiece and separated from one another again once the workpiece has solidified. The removed workpiece has a finely stepped surface from which just small quantities of material need to be removed by cutting in order to achieve the desired surface.

In a modification of the embodiment described above the surface of the individual moulding pin units may additionally be machined with a multiaxis CNC milling machine following the axial adjustment of the moulding pins 64, so that the end face of a moulding pin unit corresponds with a tolerance of 0.1 to 0.2 mm in practice to an associated region of the desired workpiece surface. After being inserted in the box parts 14, the moulding pin units 44 thus machined then form a smooth mould surface 62 which closely approaches the desired workpiece surface.

If long-stroke multiaxis CNC machines are available, the shaping of the mould surface 62 by re-milling can also be carried out after the pre-adjusted moulding pin units 44 have been inserted in the box parts 12 and 14.

In a further modification a continuous mould surface can also be achieved by smoothing the finely stepped mould surfaces obtained after fitting pre-adjusted moulding pin units 44 into the box parts 14 of the moulding boxes 10, 12 with a pasty material (e.g. graphite slurry), e.g. using rubber scrapers or similar. A very good approximation of the mould surface 62 to the desired workpiece surface is thus obtained, although the moulding pins 64 remain unchanged.

A casting mould produced with the use of graphite moulding pins, as described above, can be used for the sequence casting of a relatively small number of workpieces, e.g. for casting three to five propeller vanes for a marine propeller. The moulding pin units can continue to be used afterwards to produce casting moulds for other workpieces.

Figure 8:
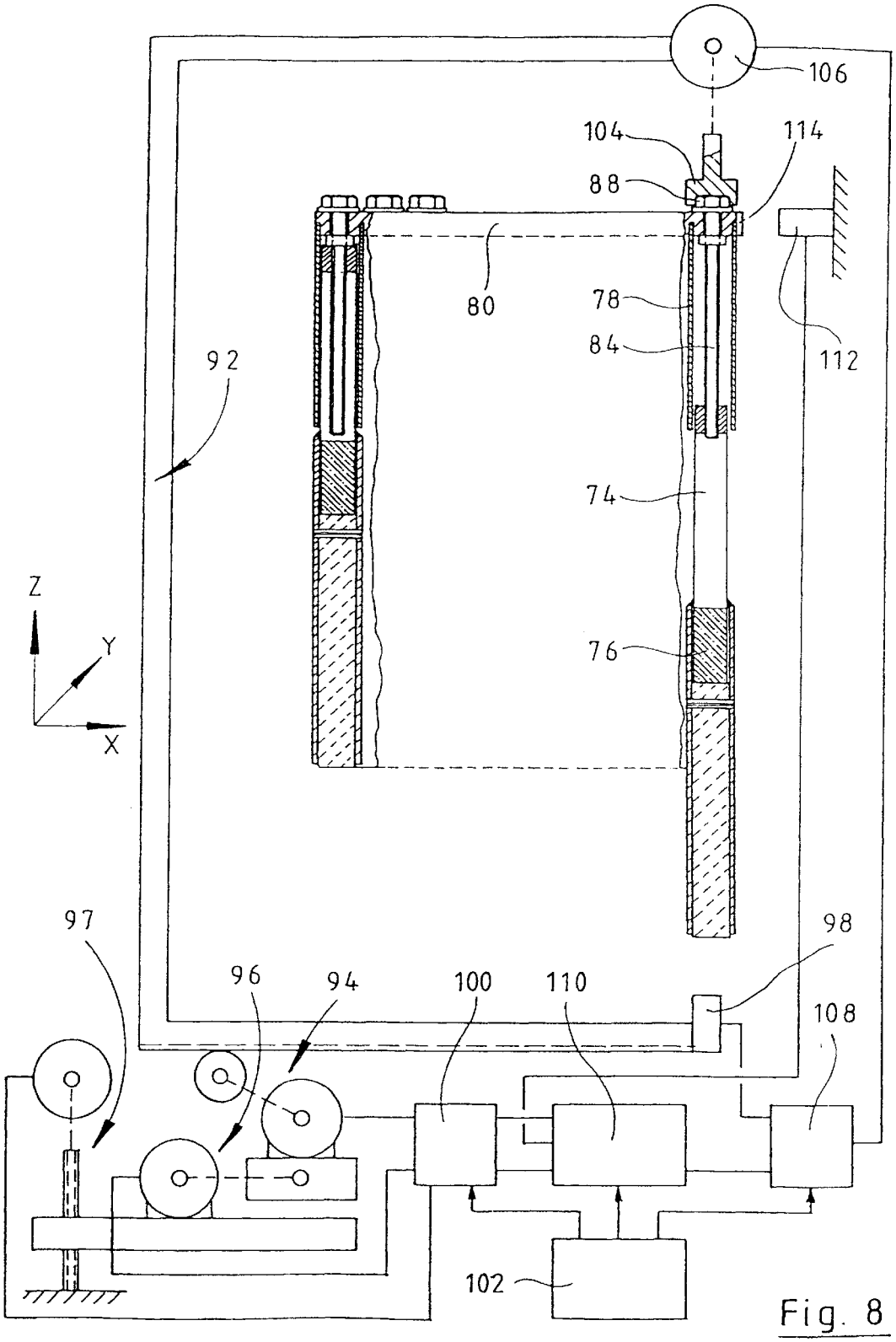
FIG. 8 is a diagrammatic representation of a device for automatically positioning the moulding pins of a moulding pin unit in the axial direction and FIG. 9 is a longitudinal section through a modified moulding pin and its displacement mechanism.

The axial adjustment of the moulding pin end faces can be automatically carried out in a simple manner and allowing for individual wear of the moulding pins with a device as reproduced diagrammatically in FIG. 8.

A C-shaped bow part 92 can be displaced by coordinate drives 94, 96, 97, which are only indicated diagrammatically, in the x, y and z directions. A gap sensor 98, which is borne by the lower arm of the bow part 92, can be positioned below the end faces of the various moulding pins 64 of a moulding pin unit 44 one after the other through displacement in the x and y directions. This is carried out under the control of a control unit 100, which operates subject to a master control 102. The upper arm of the bow part 92 bears a boss 104, in vertical alignment with the gap sensor 98, which can be turned through predetermined angles in one or the other direction by a servomotor 106.

The servomotor 106 is controlled by a control unit 108, which receives the output signal of the gap sensor 98 at a first input and a desired position signal, provided by a mould surface memory 110, for the end face of the moulding pin under consideration at a second input. A set of data corresponding to the finely stepped mould surface 62 is stored in the mould surface memory 110. The mould surface memory 110 is loaded via an interface associated with the master control 102 according to data derived from CAD data for the workpiece to be produced (provision of overdimension required, step formation).

The mould surface memory 110 is on the one hand addressed according to the subsequent position of the moulding pin unit 44 in the mould surface 62. For this purpose a read head 112 reads a machine-readable coding 114 applied to the side of the carrier plate 80. This forms a partial address for the mould surface memory 110. The other address parts were formed by the signals which correspond to the x and y positions of the bow part 92 and which are delivered by the control unit 110 to other address terminals of the mould surface memory 110. The mould surface memory 110 thus provides a desired position signal corresponding to the desired position of the end face of the moulding pin which lies directly before the gap sensor 98.

In a modification of the embodiment described above the operation can also be carried out with moulding pin units 44 which are not initially individualised by a coding, and the read head 112 can be replaced by a write head, e.g. an ink-jet write head, which writes an instruction on the carrier plate 80 as to where the moulding pin unit 44 should be fitted in the box part, e.g. a specification "third rail, sixth position". In the case of the y-displacement of the carrier plate, such man-readable information can be applied during the adjustment of the moulding pin row adjacent to the write head. It is also possible to alternatively or additionally write the information on the carrier plate in machine-readable form.

Figure 9:
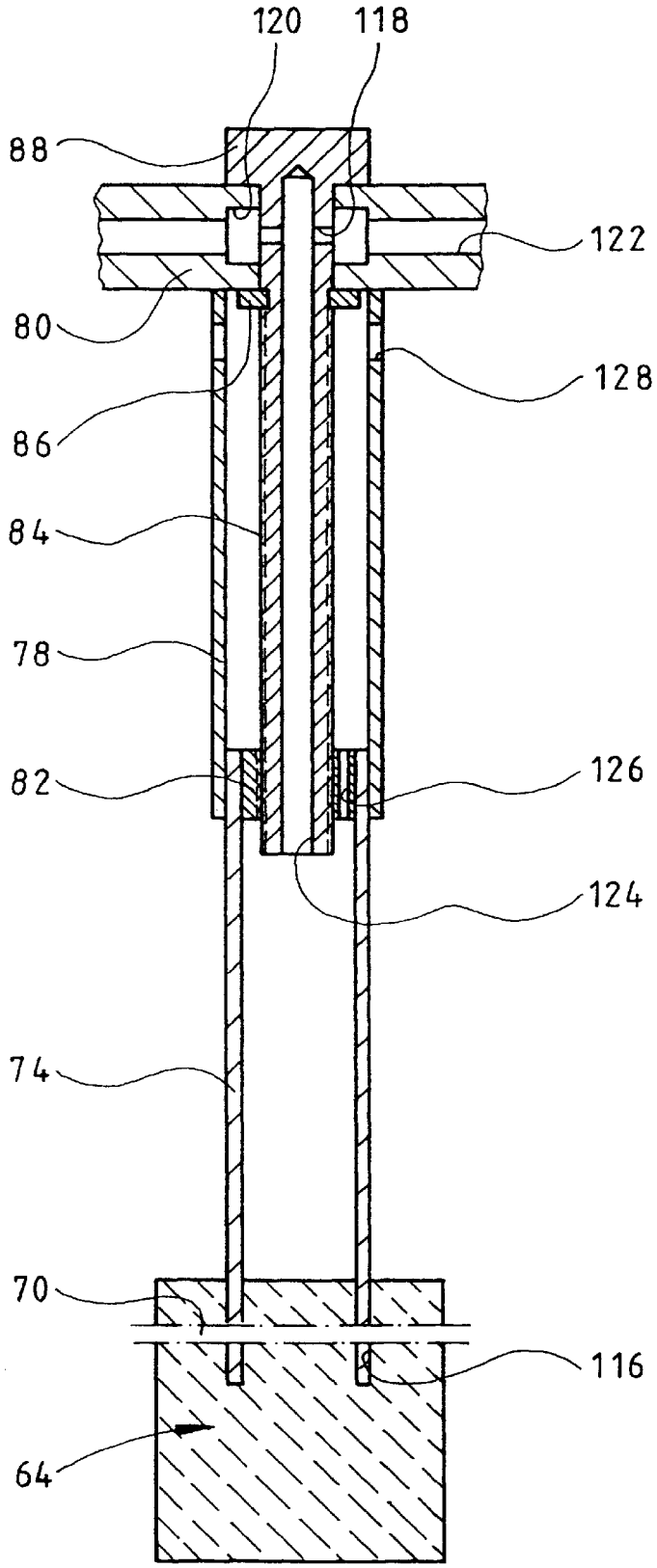

In the embodiment according to FIG. 9 the same reference numbers have again been given to those components involved in mounting the moulding pins which have already been discussed in terms of their equivalent functions with reference to FIGS. 1 to 4.

A graphite moulding pin 64 of short axial construction has a sleeve-shaped recess 116, by means of which it is inserted directly in the end of the inner telescopic part 74 and secured therein by the pin 70. The adjusting bolt 84 is formed as a hollow bolt and comprises radial feed openings 118 in its section which lies in the carrier plate 80. These openings communicate via a ring groove 120, which has a flow cross section which is large in comparison with the total area of the feed openings 118, with a feed channel 122 extending in the longitudinal direction of the plate and intersecting the successive ring grooves of a row of moulding pins.

The axial channel 124 formed in the adjusting bolt 84 leads freely into the telescopic part 74. The spindle nut 82 is formed with a plurality of axial passages 126 distributed in the circumferential direction, and waste air openings 124, distributed in the circumferential direction, are provided in the upper end section of the telescopic part 78.

The feed channels 128 of successive moulding pin units 44 are thus connected when the latter are brought into abutment in a rail 28. If the ends of the feed channels 128 associated with the various rails 28 are connected to a compressed-air source, compressed air will flow through the channels 124 of the various adjusting bolts 84 into the interior of the inner telescopic part 74, be reflected by the rear end face of the graphite moulding pin 64 and flow via the passages 126 into the space above the moulding pins 64 lying next to one another in abutment so as to be fluid-tight.

The waste cooling air can flow off through openings, which are not shown in the drawings, provided in the side walls of the box parts 14.

In the embodiment according to FIG. 9 the moulding pins 64 are not surrounded by a sheath and therefore alone form the mould surface 62. This is of advantage with regard to particularly easy precision-machining of the mould surface. The mould can be restored to a new state with just a little waste by replacing the moulding pins, which are only of a low volume.

In the embodiment according to FIG. 9 the moulding pin 64 also has greater radial dimensions than the telescopic parts 74, 78. This is of advantage with regard to reducing the number of telescopic guides and screw drives required overall, if a somewhat rougher graduation of the mould surface is acceptable.

In the embodiments described above a threaded spindle and a spindle nut co-operating with the latter in each case formed a self-locking screw drive for adjustably supporting a moulding pin or a moulding pin group. Other stanchions which are adjustable in length and which may also be used when the support has a good thermal shield against the mould cavity are hydraulic or pneumatic working cylinders with a locking device or other linear drives, e.g. racks moved by pinions.

What is claimed is:

1. Adjustable casting mould, with a box part and with a plurality of abutting moulding pins which define a mould surface and are borne by the box part, wherein the moulding pins are each supported by an extensible stanchion that adjusts said plurality of moulding pins in the axial direction and wherein at least one mould surface comprises a plurality of carrier plates, each bearing a group of extensible stanchions, said carrier plates in turn being fastened to the box part with means for adjusting said carrier plates in the longitudinal direction of the pins.

2. Casting mould according to claim 1, wherein the extensible stanchion comprises a self-locking screw drive.

3. Casting mould according to claim 1, wherein the moulding pins are each connected to a guide section which runs in a stationary guide part.

4. Casting mould according to claim 3, wherein the guide sections are each connected to the moulding pins via an insulating piece.

5. Casting mould according to claim 3, wherein said extensible stanchions each comprise an adjusting bolt, which co-operates with a spindle nut borne by the guide section, and extends through the guide part, and wherein the adjusting bolts are each connected via an axial/radial bearing to a carrier plate of said carrier plates, which in turn is mounted on the box part.

6. Casting mould according to claim 1, wherein the moulding pins are made of a material with a low coefficient of thermal expansion.

7. Casting mould according to claim 1, wherein the moulding pins are made of a material which is easily machined as compared to metal.

8. Casting mould according to claim 6, wherein the moulding pins are surrounded at least partly by a sheath comprising a heat-resistant material which is mechanically strong.

9. Casting mould according to claim 1, wherein said means for adjusting said carrier plates are connected to mounting sections comprising a plurality of locating openings, the latter being spaced in the longitudinal direction of the pins, and comprised a fastening part borne by the box part via locating pins.

10. Casting mould according to claim 1, wherein the carrier plates are connected to running heads which run in rails borne by the box part.

11. Casting mould according to claim 1, comprising moulding pin units of different sizes in different regions of the mould, which units each are comprised of a carrier plate of said carrier plates and said plurality of moulding pins or a single moulding pin borne by the carrier plate.

12. Casting mould according to claim 1, wherein the box part comprises a door in at least one of the side walls of the box part.

13. Casting mould according to claim 1, wherein the box part comprises a heat-resistant lining of low thermal conductivity on the inside of the box part.

14. Casting mould according to claim 1, wherein the end faces of the moulding pins are machined to form a continuous mould surface.

15. Casting mould according to claim 1, wherein a stepped surface formed by the moulding pin end faces is at least partly coated by a heat-resistant mouldable material to form a continuous mould surface.

16. Casting mould according to claim 1, wherein the moulding pins or the extensible stanchions carrying said moulding pins are formed at least in sections as hollow parts.

17. Casting mould according to claim 16, wherein the hollow parts are connected to a supply line for coolant.

18. Device for adjusting the mould surface of a casting mould according to claim 1, comprising a gap sensor, which is movable in a reference plane and produces an output signal associated with the gap between the end face of the moulding pin positioned in front of it at the time and the reference plane, a mould surface memory, which is addressed according to the position of the gap sensor, a control unit, which receives the output signals from the gap sensor and the mould surface memory, and a drive unit, which is controlled by the control unit, is coupled to the gap sensor to move with it in relation to the moulding pin arrangement and acts on a screw drive of the moulding pin positioned in front of the gap sensor, as a result of all of which the end face of the moulding pin is moved into a position corresponding to the desired point of the workpiece mould surface.

19. Casting mould according to claim 6, wherein the moulding pins are made of one of graphite and wood.

20. Casting mould according to claim 7, wherein the moulding pins are made of one of graphite and wood.

21. Casting mould according to claim 8, wherein the sheath comprises steel.

22. Casting mould according to claim 15, wherein a parting compound is disposed in between said heat-resistant mouldable material and said surface of the moulding pins.

* * * * *